United States Patent [19]

Kourimsky et al.

[11] 4,054,355

[45] Oct. 18, 1977

[54] BATTERY TERMINAL

[75] Inventors: Friedrich Kourimsky, Bensheim; Lothar Heinrich Willi Nix, Walldorf, both of Germany

[73] Assignee: AMP Incorporated, Harrisburg, Pa.

[21] Appl. No.: 746,265

[22] Filed: Nov. 30, 1976

[30] Foreign Application Priority Data

Dec. 5, 1975 Germany ..... 7538900[U]

[51] Int. Cl.[2] ..... H01R 11/26

[52] U.S. Cl. ..... 339/230 C; 339/263 B

[58] Field of Search ..... 339/224, 226, 229, 230 R, 339/230 C, 231, 233, 235, 260, 263 B

[56] References Cited

U.S. PATENT DOCUMENTS

| | | | |
|---|---|---|---|
| 1,810,396 | 6/1931 | Gillar | 339/235 X |
| 3,000,998 | 9/1961 | Wiora | 339/230 R X |
| 3,529,280 | 9/1970 | Best | 339/226 R |

FOREIGN PATENT DOCUMENTS

| | | | |
|---|---|---|---|
| 454,712 | 2/1949 | Canada | 339/235 |

*Primary Examiner*—Roy Lake
*Assistant Examiner*—E. F. Desmond
*Attorney, Agent, or Firm*—Allan B. Osborne

[57] ABSTRACT

A terminal for connecting a lead to a battery post which terminal is stamped and formed from a single piece of sheet metal stock and comprises a ferrule forming portion for crimping to the battery lead and a first clamping arm and a pair of second clamping arms, the first arm being struck out from the center of the stock and lateral edge portions of the stock on each side of the first arm defining the second arms which are joined at their ends, the first and second clamping arms being bowed in opposite directions for receiving between them the post and the first arm having a free end returned between the second arms which free end is adapted to receive a clamping bolt with the shank of the bolt extending between the second arms.

5 Claims, 1 Drawing Figure

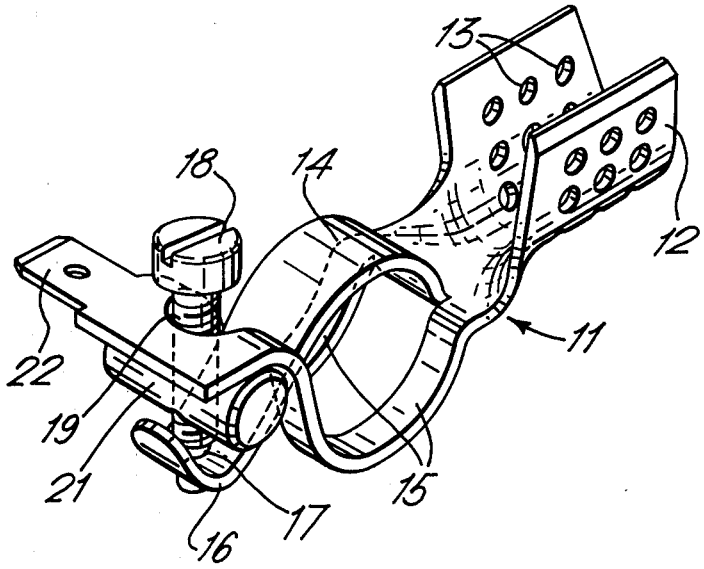
13
18
14
12
11
22
19
21
15
17
16

BATTERY TERMINAL

The invention relates to a terminal for connecting a lead to a post of an automobile battery.

It is essential that such terminal provides a good electrical contact throughout the life of the automobile to carry the heavy currents drawn by the starter motor but it is also desirable that the terminal is inexpensive to manufacture with a minimum of wastage of the relatively thick metal stock.

According to the invention, a terminal for connecting a lead to a battery post has a body stamped and formed from a single piece of sheet metal stock comprising a ferrule forming portion for crimping to the battery lead and first and second clamping arms bowed in opposite directions for receiving between them the post, a clamping member engaging free ends of the arms, the first arm being struck out from the centre of the stock, lateral edge portions of the stock on each side of the first arm defining a pair of second arms joined at their ends, the first arm having a free end returned between the second arms and having an aperture receiving a clamping bolt the shank of which extends between the second arms.

The clamping arms have a maximum area of contact with the post while the lateral spacing of the arms provides a stable clamping structure. The terminal body can be manufactured in simple stamping and forming operations and economically as a result of little scrap material.

Preferably a clamping nut is located on the bolt shank between the first and second arms.

This avoids the need to cut a screw thread in the aperture edges which would otherwise be necessary in view of the thick metal stock. The aperture need only be suitable for locating the free end of the bolt which may not be formed with a thread.

The nut may be elongate to prevent rotation on tightening the bolt.

A tab may extend from the arms at their ends remote from the ferrule for circuit testing purposes.

The ferrule forming portion may be provided with apertures enabling reliable crimping to aluminium cable.

An example of the invention will now be described with reference to the accompanying drawing which shows a perspective view of the terminal.

The terminal has a body 11 stamped and formed from a single piece of sheet metal stock comprising a U-shaped ferrule forming portion 12 provided with apertures 13 and first and second clamping arms 14 and 15, respectively. The first clamping arm 14 is struck from a central portion of the stock, residual lateral edge portions constituting the second arms 15 integrally connected together at both ends. A free end 16 of the first arm is returned between the second arms at a location remote from their root ends adjacent the ferrule and provided with an aperture 17. A clamping bolt 18 extends between the second arms with a stepped and unthreaded free end of the shank 19 located in the aperture and a clamping nut 21 of cylindrical cross-section is threaded on the shank between the first and second arms. Rotation of the bolt pushes apart the ends of the arms to embrace the battery post.

A diagnostic tab 22 extends from the second arms.

What is claimed is:

1. A terminal for connecting a lead to a battery post which terminal is stamped and formed from a single piece of sheet metal stock and comprises a ferrule forming portion for crimping to the battery lead and a first clamping arm and a pair of second clamping arms, the first arm being struck out from the centre of the stock and lateral edge portions of the stock on each side of the first arm defining the second arms which are joined at their ends, the first and second clamping arms being bowed in opposite directions for receiving between them the post and the first arm having a free end returned between the second arms which free end is adapted to receive a clamping bolt with the shank of the bolt extending between the second arms.

2. A terminal according to claim 1, in which a clamping nut is located on the bolt shank between the first and second arms.

3. A terminal according to claim 2, in which the nut is elongate.

4. A terminal according to claim 1 in which the ferrule forming portion is provided with apertures.

5. A terminal according to claim 1, in which a tab extends from the second arms.

* * * * *